US008274355B2

(12) United States Patent
Jun

(10) Patent No.: US 8,274,355 B2
(45) Date of Patent: Sep. 25, 2012

(54) TRIP DEVICE

(75) Inventor: Young Min Jun, Cheongju-si (KR)

(73) Assignee: LS Industrial Systems Co., Ltd., Anyang-si, Gyeongi-do (KR)

( * ) Notice: Subject to any disclaimer, the term of this patent is extended or adjusted under 35 U.S.C. 154(b) by 210 days.

(21) Appl. No.: 12/628,999

(22) Filed: Dec. 1, 2009

(65) Prior Publication Data

US 2010/0164676 A1 Jul. 1, 2010

(30) Foreign Application Priority Data

Dec. 31, 2008 (KR) ..... 10-2008-0138852

(51) Int. Cl.

| | |
|---|---|
| ***H01H 71/00*** | (2006.01) |
| ***H01H 61/00*** | (2006.01) |
| ***H01H 37/00*** | (2006.01) |
| ***H01H 1/00*** | (2006.01) |

(52) U.S. Cl. ..... 337/104; 337/333; 337/16; 337/85; 337/365; 337/89; 337/390; 337/398; 200/238

(58) Field of Classification Search ..... 337/77, 337/16, 85, 89, 104, 333, 365, 390, 398; 200/238

See application file for complete search history.

(56) References Cited

U.S. PATENT DOCUMENTS 2,657,292 A * 10/1953 Page ..... 337/77
2,732,455 A * 1/1956 Ericson et al. ..... 335/37
3,139,497 A * 6/1964 Giessner ..... 337/50
3,171,922 A * 3/1965 Stokes ..... 337/74
3,309,635 A * 3/1967 Walker ..... 335/35
3,313,898 A * 4/1967 Owen ..... 337/77
3,382,334 A * 5/1968 Gryctko ..... 337/38
3,408,606 A * 10/1968 Myers ..... 337/59
3,506,941 A * 4/1970 Shaffer ..... 337/106
3,548,358 A * 12/1970 Klein ..... 337/83
3,555,468 A * 1/1971 Myers ..... 335/36
3,636,410 A * 1/1972 Pardini ..... 361/95
4,168,514 A * 9/1979 Howell ..... 361/56
4,211,907 A * 7/1980 Troebel ..... 200/318
4,464,641 A * 8/1984 Bellows ..... 335/23
4,500,863 A * 2/1985 Sepulveda ..... 337/70
4,510,479 A * 4/1985 Merchant ..... 337/91
4,513,268 A * 4/1985 Seymour et al. ..... 335/35
4,630,019 A * 12/1986 Maier et al. ..... 337/70
4,675,641 A * 6/1987 Hampton et al. ..... 337/82
4,679,016 A * 7/1987 Ciarcia et al. ..... 335/132
4,695,814 A * 9/1987 Yoshiaki et al. ..... 337/77
4,714,907 A 12/1987 Bartolo et al.

(Continued)

FOREIGN PATENT DOCUMENTS

CN 1337054 2/2002

*Primary Examiner* — Bradley Thomas
(74) *Attorney, Agent, or Firm* — Lee, Hong, Degerman, Kang & Waimey

(57) ABSTRACT

A trip device is disclosed, the device comprising: a power source side heater connected to a power source side of a molded case circuit breaker (MCCB) to receive current; a load side heater connected to a load side of the MCCB to receive the current; and a bimetal including a direct heat unit contacting the power source side heater and an indirect heating unit facing the power source side heater, wherein the bimetal is partially fixed between the power source side heater and the load side heater and is curved when overcurrent or short-circuited current flows in the MCCB.

3 Claims, 6 Drawing Sheets

U.S. PATENT DOCUMENTS 4,749,829 A * 6/1988 Ikeda et al. ..... 218/143
4,771,258 A * 9/1988 Arnold ..... 337/77
4,862,131 A 8/1989 Oster et al.
5,023,416 A * 6/1991 Oyama et al. ..... 200/244
5,831,501 A * 11/1998 Kolberg et al. ..... 335/42
5,859,578 A * 1/1999 Arnold ..... 337/110
5,872,495 A * 2/1999 DiMarco et al. ..... 335/35
5,894,259 A * 4/1999 Kolberg et al. ..... 337/333
5,909,164 A * 6/1999 Lee ..... 335/202
6,054,912 A * 4/2000 Kaneko et al. ..... 335/172
6,218,917 B1 * 4/2001 Criniti et al. ..... 335/35
6,326,869 B1 * 12/2001 Felden et al. ..... 335/35
6,747,534 B1 * 6/2004 Mueller et al. ..... 335/38
6,924,446 B1 * 8/2005 Marks et al. ..... 200/318
7,391,289 B2 * 6/2008 McCoy et al. ..... 335/35
2003/0184931 A1 * 10/2003 Morris ..... 361/42
2004/0070483 A1 * 4/2004 Richter ..... 337/23

* cited by examiner

TRIP DEVICE

CROSS-REFERENCE TO RELATED APPLICATION

The present application is based on, and claims priority from, Korean Application Number 10-2008-0138852, filed Dec. 31, 2008, the disclosure of which is incorporated by reference herein in its entirety.

FIELD OF THE INVENTION

The present disclosure relates to a trip device, and more particularly to a trip device applied to a molded case circuit breaker (MCCB) which provide protection of electrical circuitry from damage due to an over-current condition when an electrical failure such as overload or short-circuit occurs.

DESCRIPTION OF THE RELATED ART

The molded case circuit breaker (MCCB) integrally housing an open/close device and a trip device in a vessel of an electrically-insulated material can open/close an electrical conductive path in response to manual or electrical manipulation, and protect an electrical circuitry from damage due to an over-current condition such as overload or a relatively high level short-circuit or fault condition by interrupting current.

In general, the MCCB refers to a circuit breaker in a molded case used for protection of an electrical circuitry of less than AC 600 volts or DC 250 volts. The MCCB is widely used to replace the conventional knife switch and fuse due to small size, easiness in manipulation and less cumbersomeness of maintenance or repair that requires replacement of fuse.

The trip device may be categorized into three types, that is, a bimetal type which carries out a trip operation by being heated and bending in response to a persistent over-current condition, an electromagnetic field type which operates by sucking a core in response to an electromagnetic field formed on a coil when an over-current flows, and an electronic type which adopts a microprocessor.

The trip characteristic is that trip activation is not operated even if a 100% rated current continuously flows but is operated for a predetermined period of time in a case when a current exceeding 125% or 150% of the rated current flows.

SUMMARY OF THE INVENTION

The present disclosure is directed to solve drawbacks of low-voltage circuit breaker and high-voltage circuit breaker and provide a multi-purpose trip device capable of improving sensitivity during interruption of over-current and obtaining reliability during interruption of short-circuited current.

In describing the present disclosure, detailed descriptions of constructions or processes known in the art may be omitted to avoid obscuring appreciation of the invention by a person of ordinary skill in the art with unnecessary detail regarding such known constructions and functions. Accordingly, the meaning of specific terms or words used in the specification and claims should not be limited to the literal or commonly employed sense, but should be construed or may be different in accordance with the intention of a user or an operator and customary usages. Therefore, the definition of the specific terms or words should be based on the contents across the specification.

In accordance with one general aspect of the present disclosure, a trip device comprises: a power source side heater connected to a power source side of a molded case circuit breaker (MCCB) to receive current; a load side heater connected to a load side of the MCCB to receive the current; and a bimetal including a direct heat unit contacting the power source side heater and an indirect heating unit facing the power source side heater, wherein the bimetal is partially fixed between the power source side heater and the load side heater and is curved when over-current or short-circuited current flows in the MCCB.

The trip device according to the present disclosure takes up both advantages of the direct heating type trip device and an indirect heating type trip device to be used as a multi-purpose trip device for both the low voltage and high voltage MCCBs.

DETAILED DESCRIPTION OF THE INVENTION

First of all, an explanation is given to an imaginary exemplary embodiment as compared with the present invention.

In a case when sensitivity is compensated for an over-current interruption to have a distinct difference for each section of a low voltage current in a low-voltage (40 A) MCCB, a trade-off may be generated that is weak in interruption of short-circuited current having an instantaneous peak value. Meanwhile, there is a drawback in a high voltage MCCB in that the over-current interruption characteristic is not distinct for each section of current size.

Figure 1:
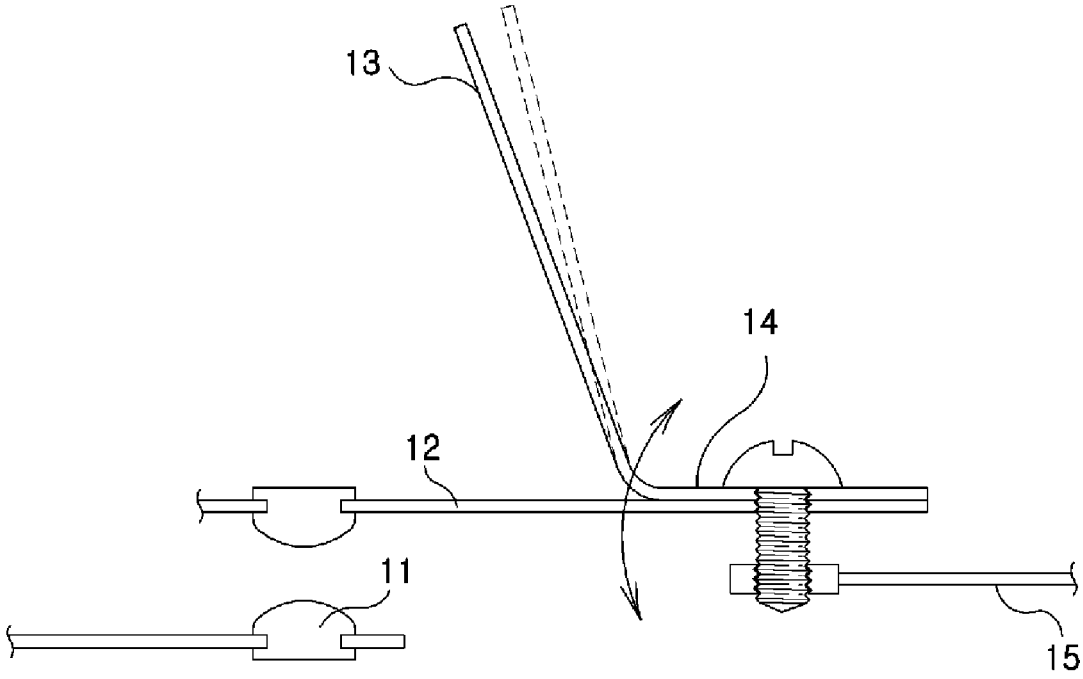
FIG. 1 is a lateral view illustrating an indirect heating type trip device as an imaginary comparative embodiment.

The bimetal may be classified into two types based on heating method, that is, an indirect heating type and a direct heating type. FIG. 1 represents a lateral view illustrating a trip device of an indirect heating type as an imaginary comparative embodiment.

FIG. 1 depicts a trip device in which a current flows from a power source side to a load side in the order of stator 11, a rotor 12 and a load terminal 15. The stator 11 is connected to a power source side, while the rotor 12 is operated by an open/close device (not shown) to be switched where contact of the rotor 12 is switched to an ON/OFF position relative to the stator 11.

The current bypasses a bimetal 13 to directly flow to a load side terminal 15. The heating of the rotor 12 by the current applied to the power source side serves to heat the bimetal 13, and the heated bimetal 13 is thermally deformed to activate the open/close device, whereby the stator 11 and the rotor 12 are disconnected to interrupt the over-current or the short-circuited current.

Figure 2:
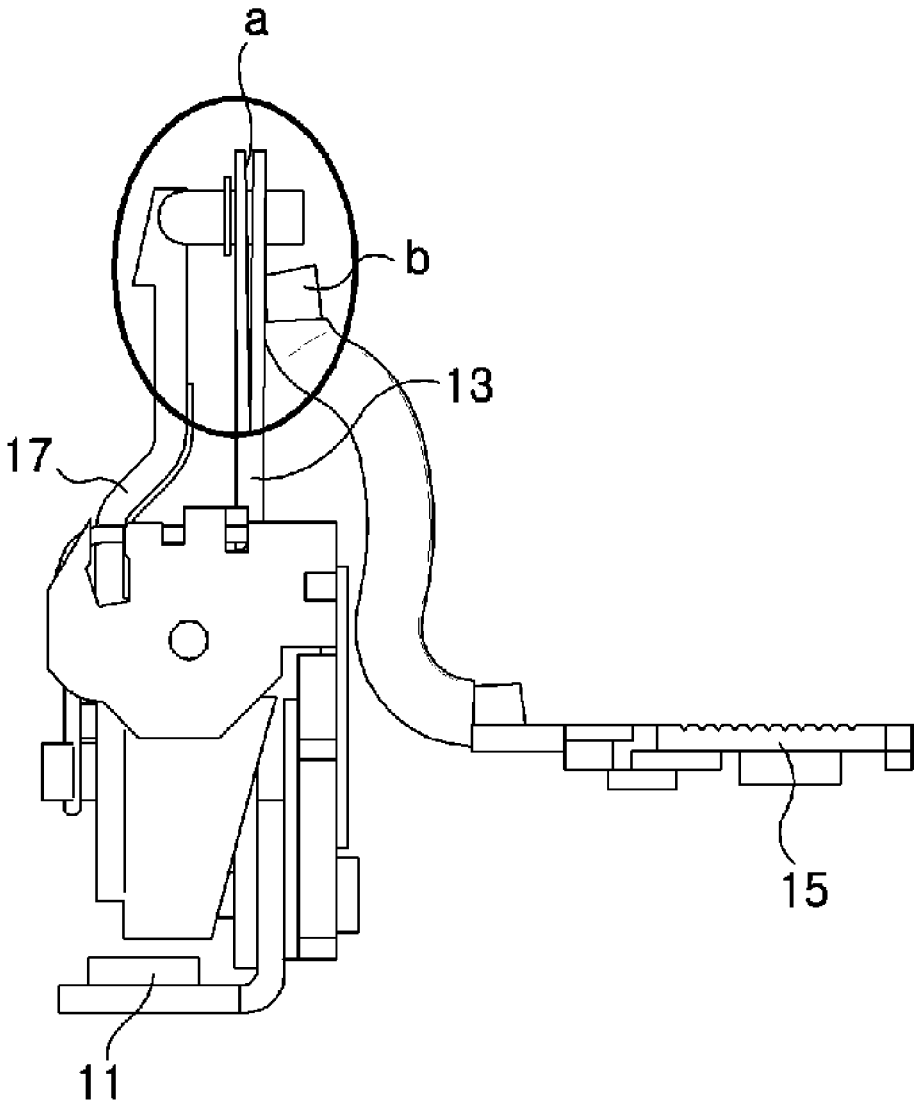
FIGS. 2 to 4 are lateral views illustrating various drawbacks of a direct heating type trip device as an imaginary comparative embodiment.

The trip device of FIG. 1 is an indirect heating type trip device that heats the bimetal 13 by transmitting the heat of the rotor 12 using a heat transmission unit 14, unlike the direct heating type trip device of FIG. 2.

The indirect heating type trip device may be adequate to a high voltage MCCB, because the bimetal 13 is not over-deformed over an entire area but is heated later by heat transmission to adjacent elements, compared to the direct heating type trip device that directly applies the current to the bimetal 13. However, there is a limit in applying to a low voltage MCCB requiring sensitivity to over-current interruption, due to the fact that the bimetal 13 is not sensitively thermally-deformed to a narrow variation width of rated current.

Figure 3:
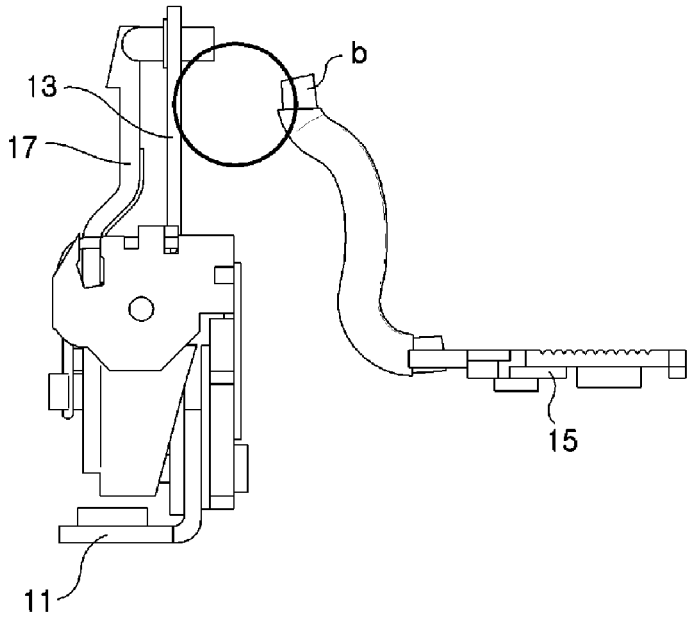
Figure 4:
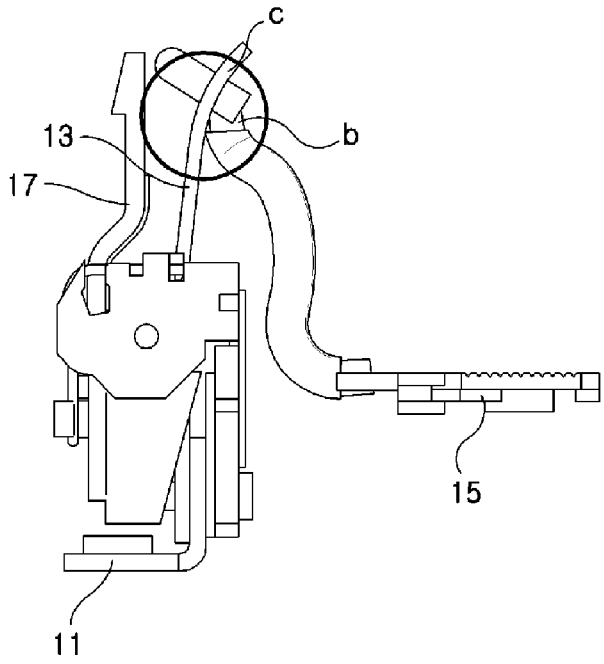

FIGS. 2 to 4 are lateral views illustrating various drawbacks of a direct heating type trip device as an imaginary comparative embodiment, where a direct heating type trip device is depicted in which a current flows to a load side terminal 15 directly through the stator 11 and the bimetal 13.

An armature 17 is instantly activated when a failure such as short-circuit is generated in a circuit to interrupt the current, where the armature 17 is therefore activated separately from the bimetal 13.

FIG. 2 illustrates a portion (a) in which the bimetal 12 which is a combination of two different materials is melted and separated when a large current is interrupted, because the bimetal 13 is directly heated by a current at the power source side. FIG. 3 illustrates a drawback in which a portion (b) welded by a wire between the load side terminal 15 and the bimetal 13 is separated due to weakness to heat, and FIG. 4 illustrates a portion (c) in which the bimetal 13 is bent reversely due to over thermal deformation over an entire area.

The present disclosure provides a multi-purpose trip device that is incorporated with advantages and that compensates disadvantages of the indirect and direct heating type trip devices, and the multi-purpose trip device proposed in the present disclosure takes up only the advantages of the indirect and direct heating type trip devices to thereby be applied to low-voltage MCCB and high-voltage MCCB at the same time.

Figure 5:
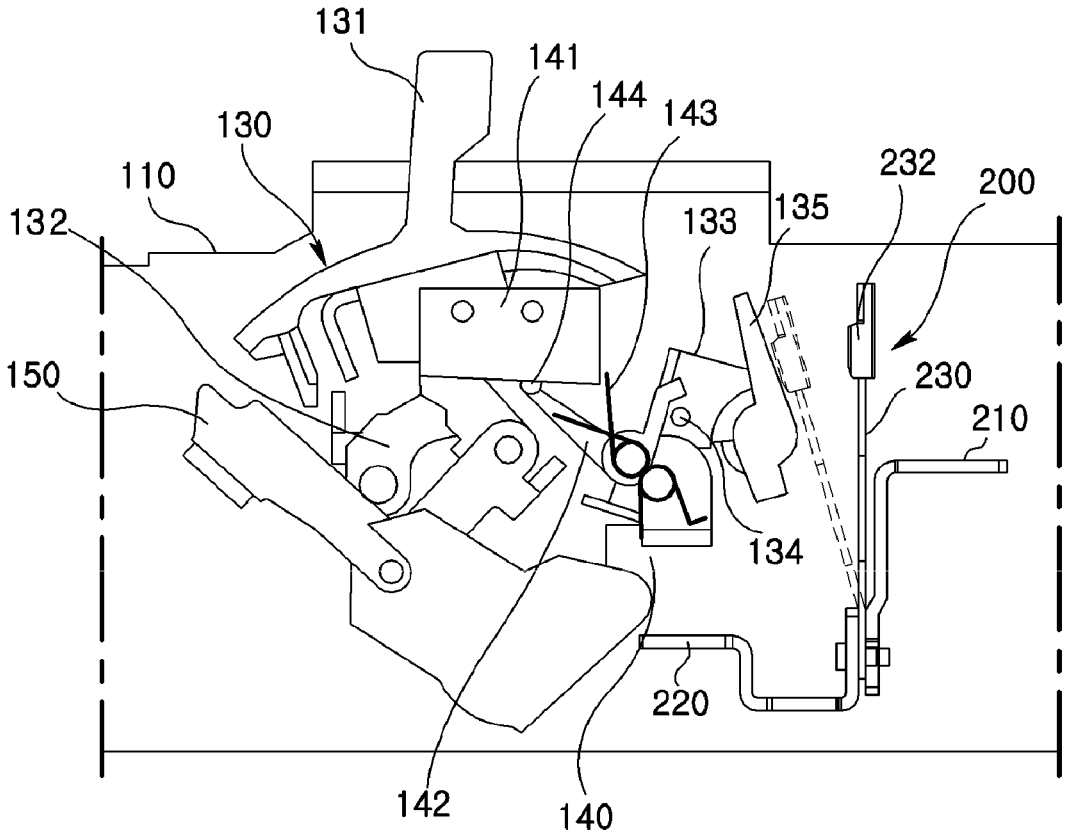
FIG. 5 is a lateral view illustrating a schematic diagram of a MCCB provided with a trip device according to the present invention.
Figure 6:
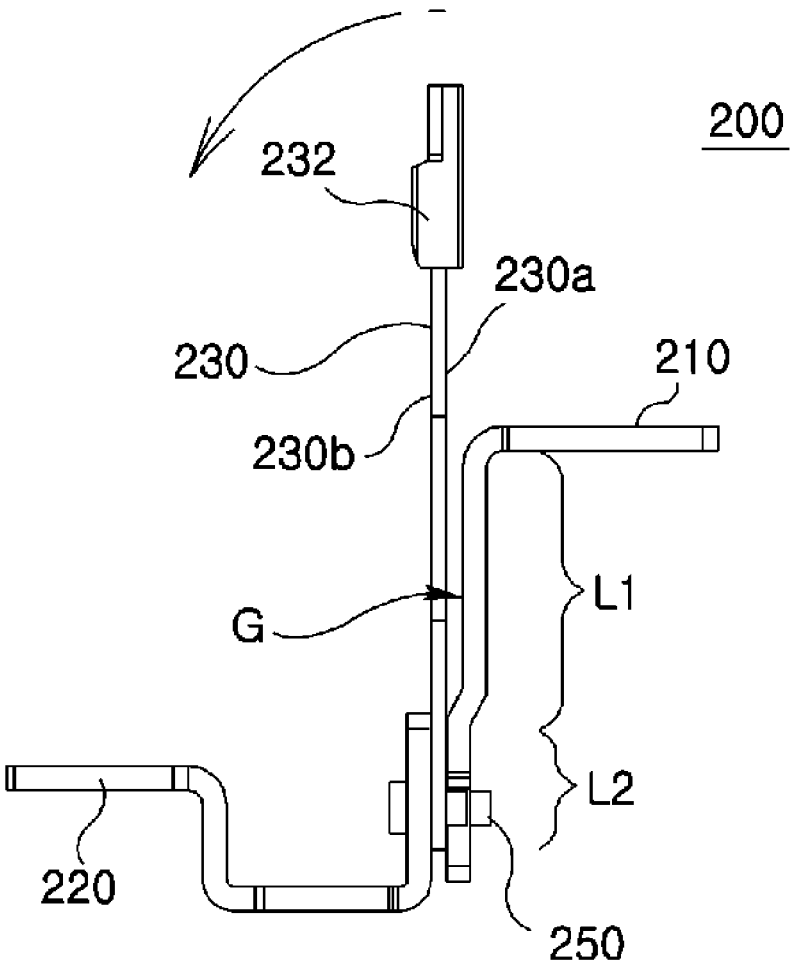
FIGS. 6 and 7 are a lateral view and a perspective view of a trip device according to an exemplary embodiment of the present disclosure.
Figure 7:
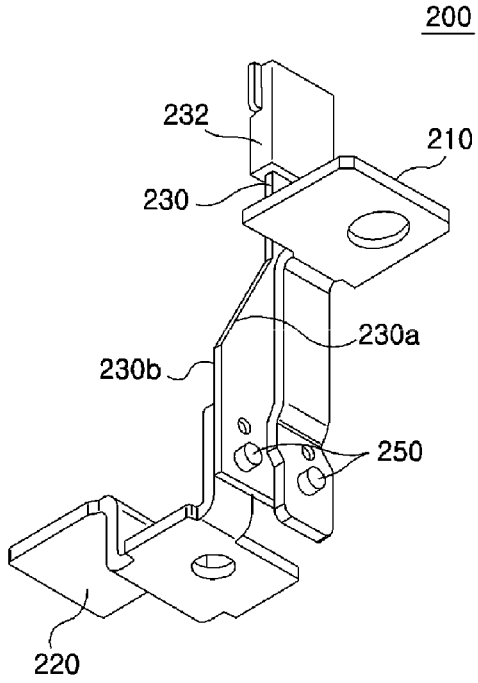
Figure 8:
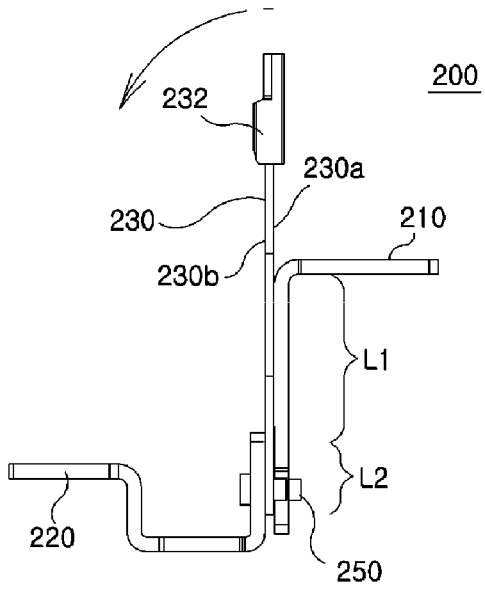
FIG. 8 is a lateral view of a trip device according to another exemplary embodiment of the present disclosure.

FIG. 5 is a lateral view illustrating a schematic diagram of an MCCB provided with a trip device according to the present invention, FIGS. 6 and 7 are a lateral view and a perspective view of a trip device according to an exemplary embodiment of the present disclosure, and FIG. 8 is a lateral view of a trip device according to another exemplary embodiment of the present disclosure.

The present disclosure now will be described more fully hereinafter with reference to FIGS. 5 to 8, in which exemplary embodiments of the present disclosure are shown. First of all, it will be understood that sizes or shapes of constituent elements may have been exaggerated for clarity and explanation of the description. Furthermore, terms and phrases used in the specification and claims may be interpreted or vary in consideration of construction and use of the present invention according to intentions of an operator or customary usages. The terms and phrases therefore should be defined based on the contents across an entire specification.

An MCCB according to FIG. 5 may include a trip device 200 mounted inside a body 110 for tripping an over-current or a short-circuited current, an open/close device 130 comprised of a plurality of links for connecting or disconnecting a rotor 150 to and from a stator (not shown) at the power source side, and a warning device 140 for indicating the presence or absence of failure such as over-current or short-circuited current in association with the open/close device 130.

The open/close device 130 may include a handle 131 rotatably supported by the body 110, a latch 132 connected to the handle 131 to be changed in response to the rotation of the handle 131 and to move the rotor 150, a latch holder 133 connected to the latch 132 to restrict the operation of the latch 132, a driving pin 134 connected to the latch holder 133 to move in response to the movement of the latch holder 133, and a cross bar 135 restricting the latch holder 133.

The warning device 140 may include a micro switch 141 mounted inside the body 110 and having a contact point 144 thereunder, a switching lever 142 rotatably mounted at the body 110 to be restricted by the driving pin 134 of the open/close device 130, and a spring 143 connected to the switching lever 142 to provide a restoring force.

The open/close device 130 is released by two operations, that is, a mechanical operation and an electrical operation.

First, in case of release of the open/close device 130 by the mechanical operation, a user depresses a trip button to release the open/close device 130, or the trip device 200 is activated to release the open/close device 130, the operations of which are explained below.

In a case a restricted condition of the latch holder 133 is released by the operation of the cross bar 135 to rotate the latch holder 133, the restricted condition of the latch 132 restricted by the latch holder 133 is removed, and as a result thereof, the restriction of the rotor 150 is removed to interrupt a circuit between the power source side and the load side.

At the same time, in a case the driving pin 134 is moved by the movement of the latch holder 133, the restriction of the switching lever 142 is released. As a result, the switching lever 142 is rotated clockwise by the resilient restoring force of the spring 143 to allow a distal end of the switching lever 142 to depress the contact point of the micro switch 141, whereby the micro switch 141 sends a warning signal to the outside to indicate an interrupted condition of the circuit breaker.

The release operation of the open/close device 130 by the electrical failure such as over-current or short-circuited current is explained under.

First, the cross bar 135 is pushed and moved by a curved bimetal 230 in a case an over-current flows. The latch holder 133 supported by the cross bar 135 in response to the movement of the cross bar 135 is moved to release the restriction of the latch 132 restricted by the latch holder 133, whereby the rotor 150 is released of its restriction to interrupt the circuit between the power source side and the load side.

At the same time, the driving pin 134 is moved in response to the movement of the latch holder 133 to release the restriction of the switching lever 142, and as a result thereof, the switching lever 142 is rotated clockwise by the resilient restoring force of the spring 143 to allow a distal end of the switching lever 142 to depress the contact point of the micro switch 141, whereby the micro switch 141 sends a warning signal to the outside to indicate a tripped condition of the circuit breaker.

Meanwhile, the trip device 200 according to the present disclosure may include a power source side heater 210 connected to a power source side of the MCCB {e.g., a stator (not shown)} or to the rotor 150 to receive the electric power or a current, a load side heater 220 connected to a load side of the MCCB to transmit a current of the power source, and a bimetal 230.

The bimetal 230 is partially contacted and fixed between the power source side heater 210 and the load side heater 220 to be curved when an over-current or a short-circuited current flows in the MCCB. In a case the bimetal 230 is curved, a contact piece 232 at a distal end of the bimetal 230 pushes out the cross bar 135 to release the open/close device 130.

The bimetal 230 may include a direct heating unit (L2) that is directly contacted to the power source side heater 210 to get conducted, and an indirect heating unit (L1) disposed in opposition to the power source side heater 210. The bimetal 230 is heated at the direct heating unit (L2) by heat conduction and an ohmic resistance of the direct heating unit (L2).

The bimetal 230 and the power source side heater 210 face each other to transmit the heat by way of radiation. In this case, the bimetal 230 and the power source side heater 210 may face each other as shown in FIGS. 6 and 7, or the bimetal 230 and the power source side heater 210 may be contacted as illustrated in FIG. 8.

That is to say, as shown in the exemplary embodiments of FIGS. 6 and 7, an air gap may be formed at the indirect heating unit (L1) between the bimetal 230 and the power source side heater 210, where the bimetal 230 is heated and curved by the indirect heating unit (L1) in the form of convective heat transmission.

Meanwhile, as illustrated in the exemplary embodiment of FIG. 8, the bimetal 230 and the power source side heater 210 are mutually contacted, where the bimetal 230 is heated and curved by the heat conduction of the indirect heating unit (L1).

To wrap up, the bimetal 230 and the power source side heater 210 may be mutually contacted and fixed at the direct heating unit (L2) and directly heated by the direct heating unit (L2) in the form of ohmic resistance to thereby obtain a heating effect by heat conduction. This corresponds to the function of the direct heating type device. In the meantime, an indirect heating effect may be obtained by using the indirect heating unit (L1) in the form of convection or conductive heat transmission. This corresponds to the function of the indirect heating type device.

Therefore, the trip device according to the present disclosure can take up both the advantages of the direct heating type trip device and the indirect heating type trip device, such that the trip device according to the present disclosure can be used as a multi-purpose trip device that can be used for both the low-voltage MCCB and the high voltage MCCB.

Meanwhile, the bimetal 230 of the direct heating unit (L2) is configured in such a manner that a first surface 230*a* is contacted and fixed by the power source side heater 210, and a second surface 230*b* (which is a rear surface of the first surface 230*a*) is contacted and fixed by the load side heater 220. Material of the first surface 230*a* is different from that of the second surface 230*b* in the bimetal 230 which is a combination of different materials.

In a case the first surface 230*a* is fixed by the power source side heater 210 and the load side heater 220, only one material may be heated as shown in FIG. 2 to generate a fusion, and in order to prevent the fusion, it is therefore preferable that the first surface 230*a* be fixed by the power source side heater 210 while the second surface 230*b* of the bimetal 230 be fixed by the load side heater 220. Therefore, the fusion of FIG. 2 and the reverse curving of FIG. 4 that might be generated when heating is concentratively applied to a single material can be restricted.

It is also preferable that the power source side heater 210 and the load side heater 220 be fixed to the bimetal 230 by a rivet 250. The reason of fixing by rivet 250 is to reduce or restrict the occurrence of defect of FIG. 3, in which case the fixation by welding or bonding method is destructed by thermal energy.

Meanwhile, a fixed contact position of the power source side heater 210 and a fixed contact position of the load side heater 220 relative to the bimetal 230 are preferably placed at the same height when viewed in a direction the bimetal 230 is extended. Therefore, the entire area of the bimetal 230 is not affected by the occurrence of over-current which only affects the direct heating unit (L2), such that the over-current affects part of the bimetal 230 to prevent the possible defect as exemplified in FIG. 4.

Meanwhile, a fixed contact position of the power source side heater 210 and a fixed contact position of the load side heater 220 relative to the bimetal 230 are preferably placed at different places when vertically viewed in a direction the bimetal 230 is extended, which enables formation of the riveted positions at the same height as noted above, and obtainment of heating effect by the ohmic resistance of the direct heating unit (L2) at each riveted position.

It will be appreciated that the examples disclosed herein are not to be construed as limiting of the disclosure as they are intended merely as illustrative of particular embodiments of the disclosure as enabled herein. Indeed, various modifications of the disclosure in addition to those shown and described herein will become apparent to those skilled in the art from the foregoing description and fall within the scope of the appended claims. It is therefore evident that the particular embodiments disclosed above may be all or partially altered or modified, and such features or aspects may be combined with one or more other features and/or aspects of other implementations as may be desired.

What is claimed is:

1. A trip device comprising:

a power source side heater connected to a power source side of a molded case circuit breaker (MCCB) and configured to receive current;

a load side heater connected to a load side of the MCCB and configured to receive the current; and a bimetal including a direct heating portion that contacts the power source side heater and an indirect heating portion facing the power source side heater, wherein:

a first surface of the bimetal is fixed to the power source side heater;

a second surface of the bimetal is fixed to the load side heater, the second surface being on a side of the bimetal that is opposite to the first surface;

the first surface is formed from a first material that is different from a second material that forms the second surface;

the power source side heater and the load side heater are fixed to the bimetal by a fastener;

the power source side heater and the load side heater are fixed to the bimetal at positions located at a substantially same height when viewed in a direction in which the bimetal is extended;

an air gap is formed at the indirect heating portion between the bimetal and the power source side heater; and the bimetal is partially fixed between the power source side heater and the load side heater and configured to bend substantially at an intersection between the direct heating portion and the indirect heating portion in order to be curved when over-current or short-circuited current flows in the MCCB.

2. The trip device of claim 1, wherein a fixed contact position of the power source side heater relative to the bimetal and a fixed contact position of the load side heater relative to the bimetal are located at different places when vertically viewed in the direction in which the bimetal is extended.

3. The trip device of claim 1, wherein the bimetal is curved when the bimetal is heated by the direct heating portion via ohmic resistance and heated by the indirect heating portion via convective heat transmission.

* * * * *